US005474169A

United States Patent [19]

Bauman

[11] Patent Number: 5,474,169

[45] Date of Patent: Dec. 12, 1995

[54] DISPOSABLE CONTACT LENS STORAGE CONTAINER

[76] Inventor: Robert C. Bauman, 232 Goodhouse Rd., Litchfield, Conn. 06759

[21] Appl. No.: 229,003

[22] Filed: Apr. 18, 1994

[51] Int. Cl.[6] ..... A45C 11/04

[52] U.S. Cl. ..... 206/5.1; 206/205; 206/461

[58] Field of Search ..... 206/5.1, 205, 461, 206/467

[56] References Cited

U.S. PATENT DOCUMENTS

| | | | |
|---|---|---|---|
| 2,816,666 | 12/1957 | Nadel | 206/461 |
| 3,311,229 | 3/1967 | Troll et al. | 206/461 |
| 3,371,777 | 3/1968 | Lilly | 206/461 |
| 3,495,759 | 2/1970 | Bergstrom et al. | 206/525 |
| 3,780,856 | 12/1973 | Braverman | 206/461 |
| 3,977,517 | 8/1976 | Kadlecik et al. | 206/5.1 |
| 3,990,579 | 11/1976 | Manning . | |
| 4,091,917 | 5/1978 | Clawson et al. . | |
| 4,332,318 | 6/1982 | Feldman . | |
| 4,392,569 | 7/1983 | Shoup . | |
| 4,508,216 | 5/1985 | Kelman . | |
| 4,543,882 | 10/1985 | Ryder et al. | 206/5.1 |
| 4,545,478 | 10/1985 | Waldman . | |
| 4,605,127 | 8/1986 | Magnussen, Jr. | 206/525 |
| 4,691,820 | 9/1987 | Martinez | 206/5.1 |
| 4,697,703 | 10/1987 | Will | 206/525 |
| 4,710,023 | 12/1987 | Loveridge | 206/5.1 |
| 4,981,657 | 1/1991 | Ryder . | |
| 5,054,610 | 10/1991 | Ajello | 206/5.1 |
| 5,071,276 | 10/1991 | Nielsen et al. | 206/5.1 |
| 5,101,967 | 4/1992 | Sibley | 206/5.1 |
| 5,143,660 | 9/1992 | Hamilton | 206/1.5 |
| 5,337,888 | 8/1994 | Morrison | 206/5.1 |

*Primary Examiner*—David T. Fidei
*Attorney, Agent, or Firm*—Pepe & Hazard

[57] ABSTRACT

A lens storage container includes an integrally formed receptacle member having a bottom wall and a sidewall providing a cavity. An upstanding post on the upper surface of the bottom wall has a convexly curved upper end which is spaced below the upper end of the sidewall and seats a contact lens. The post is spaced inwardly from the sidewall along one axis of the receptacle to allow a pair of the users's fingers to be placed upon the post below its upper end and to move upwardly into contact with the periphery of a lens seated thereon. A closure extends across the cavity and is secured to the receptacle member.

14 Claims, 3 Drawing Sheets

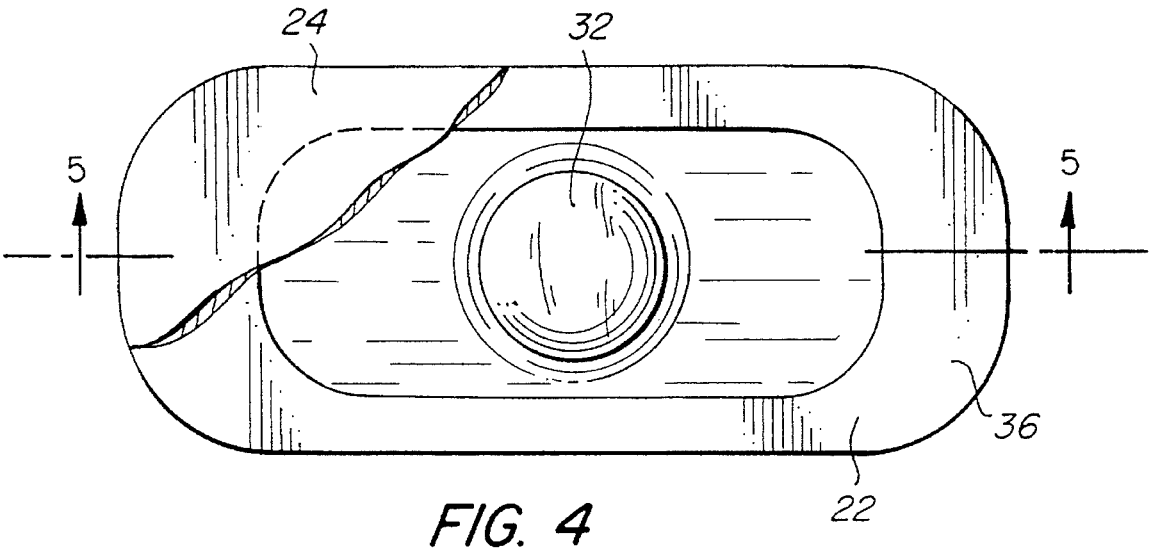
FIG. 4
FIG. 5
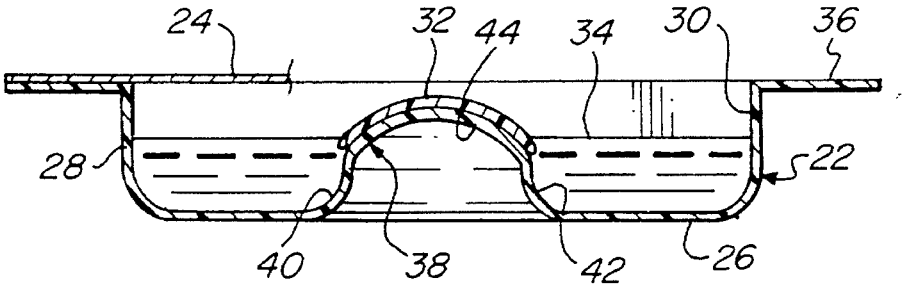
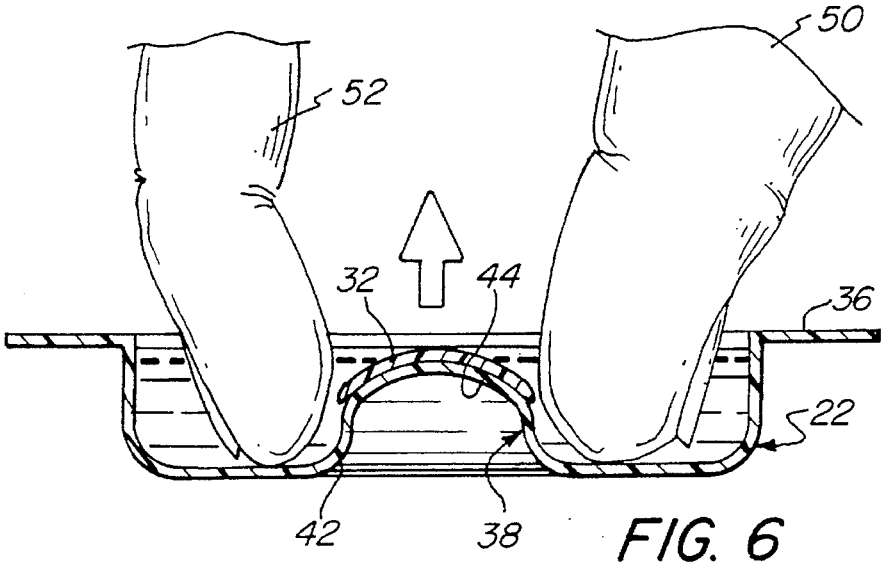
FIG. 6

DISPOSABLE CONTACT LENS STORAGE CONTAINER

BACKGROUND OF THE INVENTION

The present invention relates to contact lens storage containers, and, more particularly, to disposable storage containers for contact lenses.

Many different types of containers have been used for storage of contact lenses. Some of these are relatively durable molded structures intended for repeated use and include replaceable covers. Others are relatively low cost disposable structures for storage of the lens prior to use by the wearer. Recently, the increasing use of disposable contact lens has resulted in efforts to produce lower cost containers.

All such storage containers must be relatively free from leakage of liquid and vapor to ensure that the lens will be immersed in the liquid within the container or exposed to a highly moist atmosphere so that the lens retains its high moisture content. Typical disposable lens containers have a molded receptacle and a foil cover which can be peeled therefrom.

Some permanent lens storage containers have employed complex structures for seating the lens at a specific position within the container. Illustrative of such containers are Ryder U.S. Pat. No. 4,981,657 which has a hanger with spheric surfaces to seat the contact lens and Kadlecik et al U.S. Pat. No. 3,977,517. Manning U.S. Pat. No. 5,990,579 provides a container with a base providing a convex surface and a cap with a concave surface to locate the lens therebetween. Shoup U.S. Pat. No. 4,392,569 employs a similar combination of convex/concave opposed surfaces. Waldman U.S. Pat. No. 4,545,478 positions the lens on a hanger molded on the cap between opposed concave/convex surfaces. Clawson et al U.S. Pat. No. 4,091,917 provides a concave surface on the cover to which the lens will adhere.

As can be seen, these are all relatively complex structures which are relatively expensive to fabricate.

It is an object of the present invention to provide a novel disposable contact lens storage container for locating the lens and enabling its convenient removal from the container.

It is also an object to provide such a container which limits the potential for damaging the lens during removal.

A further object is to provide such a container which may be fabricated readily and economically.

SUMMARY OF THE INVENTION

It has now been found that the foregoing and related objects and advantages may be readily attained in a contact lens storage container having an integrally formed receptacle member with a bottom wall, and a sidewall extending upwardly from the periphery of the bottom wall and cooperating therewith to provide a cavity opening at the upper end of the sidewall. An upstanding post on the upper surface of the bottom wall has a convexly curved upper end which is spaced below the upper end of the sidewall. The post is spaced inwardly from said sidewall along one axis of said receptacle to allow a pair of digits of the hand of a user to be placed upon the post below said upper end and to move upwardly therealong to bring the user's digits into contact with the periphery of a lens seated thereon. The container also includes a closure extending across the cavity and secured to the receptacle member.

Preferably, the bottom wall outwardly of the post extends in a common plane, and the juncture of the post with the bottom wall is generally concavely arcuate.

Desirably, the receptacle member has an outwardly extending flange at the upper end of the sidewall to which the closure is releasably engaged, and the radius of the curvature of the upper end of the post is about 5.7 to 11.7 millimeters.

In its preferred form, the receptacle member is generally rectangular and elongated and the one axis the spacing for the user's fingers is provided in the elongated axis. In one embodiment, the bottom wall tapers downwardly and outwardly from the post along one axis of the receptacle member, and most desirably along both axes.

Conveniently, the receptacle member is integrally molded of synthetic resin and the post is hollow. The closure will normally include a metallic foil.

BRIEF DESCRIPTION OF THE DRAWINGS

FIG. 4 is a plan view of a lens storage container embodying the present invention with the closure broken away and a lens positioned on the post;

FIG. 5 is a sectional view thereof along the line 5—5 of FIG. 4;

FIG. 6 is a sectional view of the lens storage container with the closure removed and with a user's fingers moving to a position to remove the contact lens from the post;

DETAILED DESCRIPTION OF THE PREFERRED EMBODIMENTS

Figure 1:
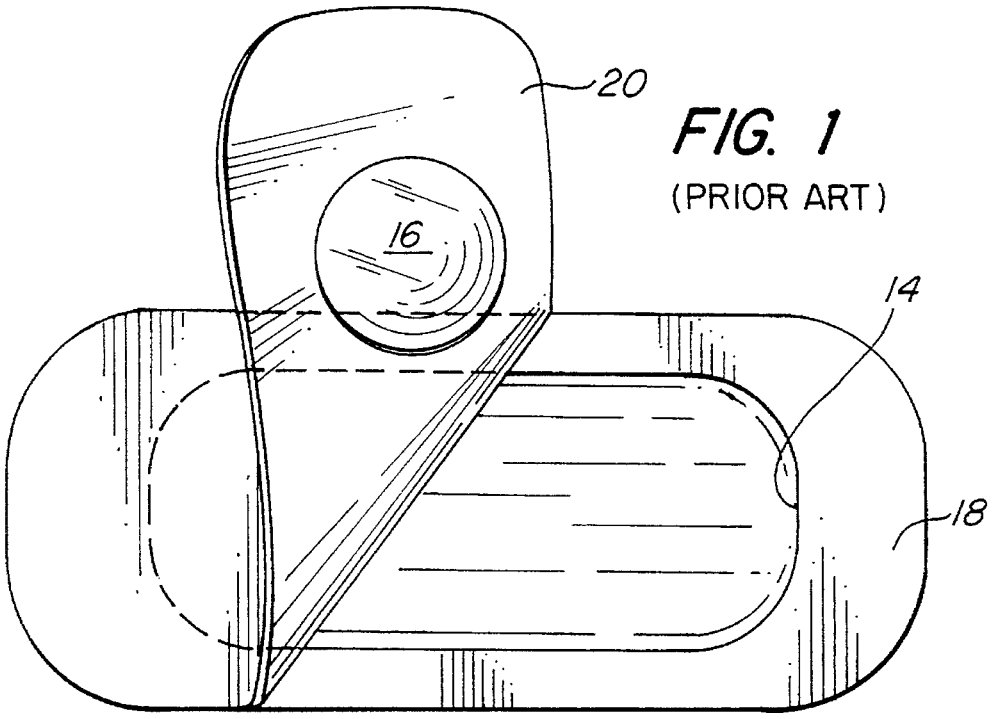
FIG. 1 (PRIOR ART)
FIG. 1 is a plan view of a prior art lens storage container with the closure partially removed.
Figure 2:
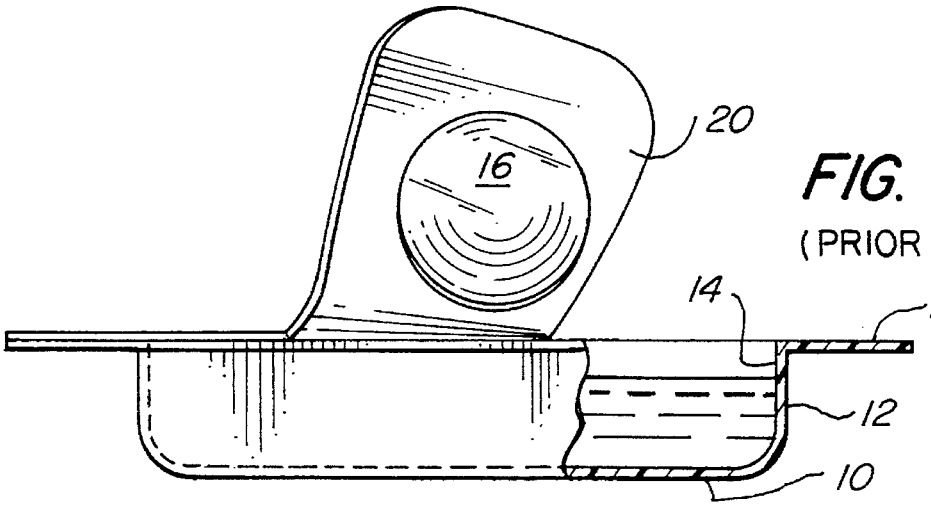
FIG. 2 (PRIOR ART)
FIG. 2 is a side elevational view thereof in partial section.
Figure 3:
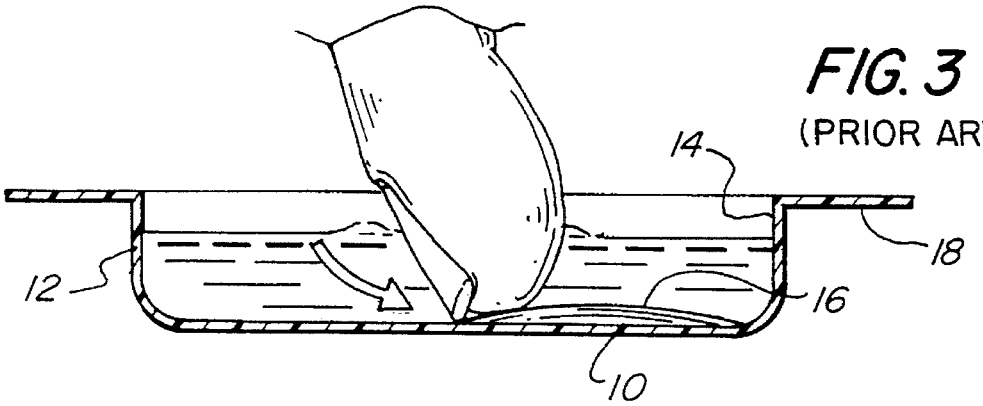
FIG. 3 (PRIOR ART)
FIG. 3 is a sectional view having the closure fully removed and a user's finger searching for the lens.

In FIGS. 1–3, there is illustrated a widely employed type of contact lens container which has a receptacle with a bottom wall 10 and a sidewall 12 extending upwardly from the periphery of the bottom wall 10. The bottom wall 10 and the sidewall 12 form a cavity 14 which holds the stored contact lens 16 and a saline solution to keep the lens moist during storage. An outwardly directed, generally planar flange 18 at the upper end of the sidewall 12 is sealingly engaged with a closure or a cover 20 which is typically a metallic foil or foil/plastic laminate adhered to the upper surface of the flange 18.

With this type of container, the lens 16 is frequently difficult to locate within the confines of the receptacle as it is free to move therein within the solution. Additionally, the lens 16 can adhere to the closure 20 or to the surface of the receptacle, and it can also fold over upon itself. This can result in damage from a fingernail or loss of the lens when the container is opened and lens removal is attempted.

Turning next to FIGS. 4 and 5, a lens storage container embodying the present invention is illustrated as comprising a receptacle generally designated by the numeral 22 and a closure 24. The receptacle 22 is of generally rectangular configuration and has a bottom wall 26 and sidewall 28 which extends upwardly from the periphery of the bottom wall 26 to provide a cavity 30 which opens at the upper end of the sidewall 28. This cavity 30 provides a compartment to contain the stored contact lens 32 and an appropriate wetting solution 34. An outwardly directed, generally planar flange 36 extends about the periphery of the upper end of the sidewall 28 and is sealingly engaged with the closure or cover 24 overlying the cavity 30.

Extending upwardly from the bottom wall 26 centrally of the receptacle is a hollow post generally designated by the numeral 38, and it has a generally circular cross section. At the juncture of the base of the post 38 and the bottom wall 26, is a concavely arcuate transitional area 40. The sidewall 42 of the post 38 tapers slightly inwardly towards the upper end 44 which is of concavely arcuate, dome-like configuration. In this embodiment, the bottom wall 26 outwardly of the post 38 lies in a common horizontal plane.

The container is elongated so that the cavity 30 is substantially longer along the elongated axis than in the shorter axis providing a substantial spacing to either side of the post 38 along the elongated axis.

As seen in FIG. 5, the contact lens 46 seats on the upper end of the post 38 which has a similar radius of curvature. The cavity 30 contains a saline wetting solution 48 to keep the lens 46 saturated.

When the user desires to remove the lens 46, the closure 24 is peeled from the flange 36 and the user inserts the thumb 50 and forefinger 52 into the cavity spacing 30 along the elongated axis as seen in FIG. 6. The fingers 50, 52 should touch the bottom wall 26 and then be moved against the post 38 and upwardly therealong so that the periphery of the lens 46 is captured therebetween. As a result, the lens 46 may be lifted from the post 38 as indicated by the arrow in FIG. 6.

Figure 7:
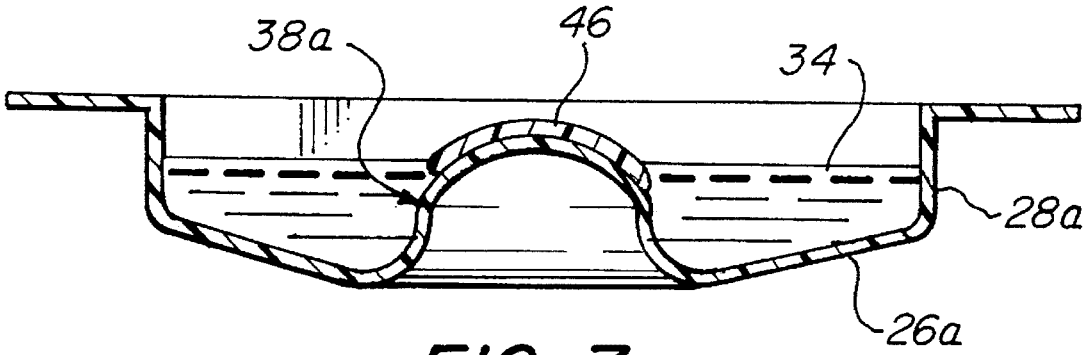
FIG. 7 is a sectional view of another embodiment of a contact lens storage container embodying the present invention showing the bottom wall inclined upwardly and outwardly from the post toward the sidewall.

Turning next to FIG. 7, the embodiment is one in which the bottom wall **26*a* of the receptacle 22*a* is inclined upwardly from the post 38*a* to the sidewall 28 in the longer axis, but is generally planar over the width of the receptacle 22*a* in the central portion defined by the width of the post 38*a* to provide for stable seating of the receptacle 22*a*** on a table or the like (not shown).

Figure 8:
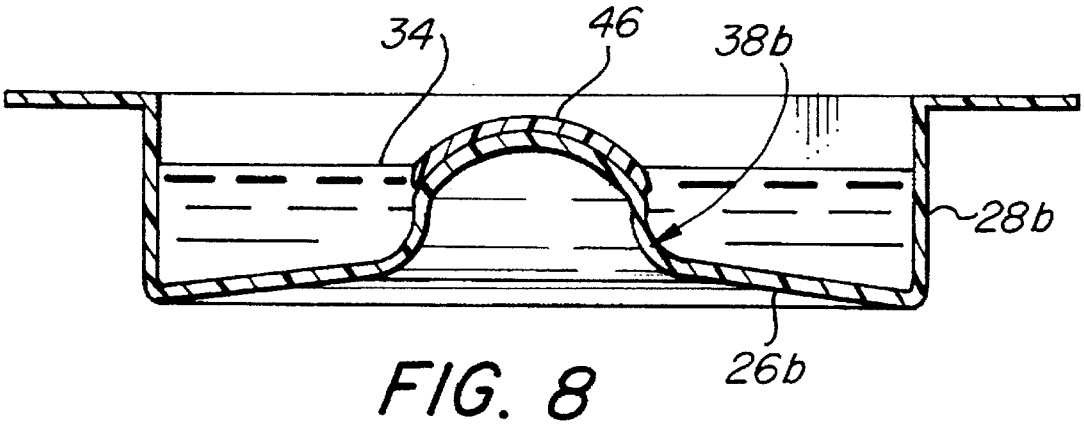
FIG. 8 is a similar view of another embodiment of a contact lens storage container of the present invention showing the bottom wall inclined downwardly and outwardly from the post toward the sidewall.

In FIG. 8, the embodiment is one in which the bottom wall **26*b* of the receptacle 22*b* is inclined downwardly from the post 38*b* to the sidewall 28*b*. In this embodiment, the bottom wall 26*b* can be inclined downwardly from the post 38*b* along both axes to a common plane defined by the juncture with the sidewall 28*b***, or only along the longer axis.

The radius of curvature of the upper end of the post should approximate the radius of curvature of the human cornea or about 5.7 to 11.7 millimeters, and preferably about 8.7 millimeters.

In using the storage container of the present invention, the manufacturer of the soft contact lens places the lens on the convex upper end of the post. Because the radius of curvature of the post is similar to that of the cornea of a human eye, the lens adheres to it by means of capillary attraction, which keeps a lens against the human cornea when the lens is placed in the eye. Just as sudden head movements will not displace a lens placed in the eye, shaking or striking the lens storage container will typically not dislodge the lens seated on the post.

It does not make a significant difference if the lens is mounted right side out or inside out. Since the lens is typically made from a very thin membrane, the lens will readily deform and adhere securely in either orientation. The orientation selected will usually depend upon the manufacturing process employed, and the user of the lens can be advised of the chosen orientation to allow for proper orientation of the lens in the eye.

The receptacle of lens storage container of the various embodiments is readily formed from synthetic resin by injection molding although thermoforming and compression molding may also be employed. Various resins may be employed including polyethylene and polypropylene which are relatively economical.

The closure or cover may be a metallic foil using an adhesive or a foil with a laminated layer or coating of resin which enables heat sealing to provide a suitable bond to the flange.

Thus, it can be seen from the foregoing detailed specification and attached drawings that the disposable lens storage container of the present invention provides convenient location of the lens and facilitates removal of the lens from the container to minimize the potential for damage to the lens during removal. The container may be fabricated readily and economically.

Having thus described the invention, what is claimed is:

1. A contact lens storage container consisting of:

(a) an integrally molded one-piece receptacle member having (i) a bottom wall with upper and lower surfaces;

(ii) a sidewall extending upwardly from the periphery of said bottom wall and cooperating therewith to provide a cavity opening at the upper end of said sidewall, said sidewall having a generally planar flange extending about its upper end; and (iii) an upstanding post on the upper surface of said bottom wall, the juncture of said post with said bottom wall being generally concavely arcuate, said post having an upper end spaced upwardly from said bottom wall and only a short distance below the plane of said flange at said upper end of said sidewall, said upper end of said post having a convexly curved lens seating surface with its center of curvature coaxial with the center of said post adapted to seat a contact lens thereon, said post being spaced inwardly from said sidewall along one axis of said receptacle a distance sufficient to allow a pair of fingers of the hand of a user to be placed upon said post below said upper end and to move upwardly therealong to bring the user's fingers into contact with the periphery of an associated lens seated thereof; and (b) a substantially planar closure extending across said cavity and secured to said planar flange of said receptacle member.

2. The contact lens storage container in accordance with claim 1 wherein said bottom wall outwardly of said post lies in a common plane.

3. The contact lens storage container in accordance with claim 1 wherein said flange of said receptacle member is outwardly extending.

4. The contact lens storage container in accordance with claim 1 wherein the radius of curvature of said convexly curved seating surface at said upper end of said post is about 5.7 to 11.7 millimeters.

5. The contact lens storage container in accordance with claim 1 wherein said receptacle member is elongated and said one axis is the elongated axis.

6. The contact lens storage container in accordance with claim 1 wherein said bottom wall is inclined downwardly from said post and outwardly from said post towards said sidewall along both axes of said receptacle member.

7. The contact lens storage container in accordance with claim 1 wherein said receptacle member is integrally molded of synthetic resin.

8. A contact lens storage container comprising:

(a) a contact lens having a radius of curvature;

(b) an integrally formed receptacle member having (i) a bottom wall with upper and lower surfaces;

(ii) a sidewall extending upwardly from the periphery of said bottom wall and cooperating therewith to provide a cavity opening at the upper end of said sidewall;

(iii) an outwardly extending flange at the upper end of said sidewall; and (iv) an upstanding post on the upper surface of said bottom wall, said post having an upper end spaced upwardly from said bottom wall and below the plane of said flange at said upper end of said sidewall, said upper end of said post having a convexly curved lens seating surface with its center of curvature coaxial with the center of said post, said lens seating surface having a radius of curvature approximating that of said contact lens so that said lens is seated thereon by surface attraction, said post being spaced inwardly from said sidewall along one axis of said receptacle a distance sufficiently to allow a pair of fingers of the hand of a user to be placed upon said post below said upper end and to move upwardly therealong to bring the user's fingers into contact with the periphery of said lens seated thereon, said bottom wall outwardly of said post lying in a common plane; and (c) a substantially planar closure extending across said cavity and secured to said flange of said receptacle member.

9. The contact lens storage container in accordance with claim 8 wherein the juncture of said post with said bottom wall is generally concavely arcuate.

10. The contact lens storage container in accordance with claim 8 wherein the radius of curvature of said upper end of said post is about 5.7 to 11.7 millimeters.

11. The contact lens storage container in accordance with claim 8 wherein said receptacle member is elongated and generally rectangular and said one axis is the elongated axis.

12. The contact lens storage container in accordance with claim 11 wherein said bottom wall is inclined downwardly from said post and outwardly from said post towards said sidewall along both axes of said receptacle member.

13. The contact lens storage container in accordance with claim 8 wherein said bottom wall is inclined downwardly from said post and outwardly from said post towards said sidewall along an axis of said receptacle member, and wherein said receptacle member is integrally molded of synthetic resin.

14. A contact lens storage container consisting of:

(a) an integrally molded one-piece receptacle member of generally rectangular configuration having (i) a bottom wall with upper and lower surfaces;

(ii) a sidewall extending upwardly from the periphery of said bottom wall and cooperating therewith to provide a cavity opening at the upper end of said sidewall, said sidewall having a generally planar flange extending about its upper end, said bottom wall being inclined downwardly from said post and outwardly from said post towards said sidewall along an axis of said receptacle member; and (iii) an upstanding post on the upper surface of said bottom wall, said post having an upper end spaced upwardly from said bottom wall and only a short distance below the plane of said flange at said upper end of said sidewall, said upper end of said post having a convexly curved lens seating surface with its center of curvature coaxial with the center of said post adapted to seat a contact lens thereon, said post being spaced inwardly from said sidewall along one axis of said receptacle a distance sufficient to allow a pair of fingers of the hand of a user to be placed upon said post below said upper end and to move upwardly therealong to bring the user's fingers into contact with the periphery of an associated lens seated thereof; and (b) a substantially planar closure extending across said cavity and secured to said planar flange of said receptacle member.

* * * * *